US011384622B2

(12) United States Patent
Abdellatif et al.

(10) Patent No.: US 11,384,622 B2
(45) Date of Patent: Jul. 12, 2022

(54) IN SITU DECONTAMINATION OF DOWNHOLE EQUIPMENT

(71) Applicant: M-I L.L.C., Houston, TX (US)

(72) Inventors: Mohammed Abdellatif, Safat (KW); Mohamed AlMahdy, Ahmadi (KW); Henricus Fortuin, Noord-Holland (NL)

(73) Assignee: CAMERON INTERNATIONAL CORPORATION, Houston, TX (US)

( * ) Notice: Subject to any disclaimer, the term of this patent is extended or adjusted under 35 U.S.C. 154(b) by 0 days.

(21) Appl. No.: 16/095,675

(22) PCT Filed: Apr. 20, 2017

(86) PCT No.: PCT/US2017/028471

§ 371 (c)(1),
(2) Date: Oct. 22, 2018

(87) PCT Pub. No.: WO2017/184793

PCT Pub. Date: Oct. 26, 2017

(65) Prior Publication Data

US 2020/0355047 A1 Nov. 12, 2020

Related U.S. Application Data

(60) Provisional application No. 62/325,198, filed on Apr. 20, 2016.

(51) Int. Cl.
*E21B 37/06* (2006.01)
*E21B 47/00* (2012.01)
(Continued)

(52) U.S. Cl.
CPC ..... *E21B 37/06* (2013.01); *E21B 33/12* (2013.01); *E21B 33/13* (2013.01); *E21B 47/006* (2020.05); *G21F 9/002* (2013.01)

(58) Field of Classification Search
CPC ..... E21B 37/06; E21B 37/00; E21B 47/006; E21B 33/12; E21B 33/13; G21F 9/002
See application file for complete search history.

(56) References Cited

U.S. PATENT DOCUMENTS 4,173,718 A * 11/1979 Fertl ..... G01V 5/04 250/259
4,973,201 A * 11/1990 Paul ..... B09C 1/02 166/311

(Continued)

FOREIGN PATENT DOCUMENTS

JP 2014-050814 A 3/2014
WO 1995/33581 A1 12/1995

OTHER PUBLICATIONS

International Search Report and Written Opinion for the equivalent International patent application PCT/US2017/028471 dated Jul. 11, 2017.

(Continued)

*Primary Examiner* — Giovanna Wright
*Assistant Examiner* — Yanick A Akaragwe
(74) *Attorney, Agent, or Firm* — Helene Raybaud

(57) ABSTRACT

A method of decontaminating naturally occurring radioactive material (NORM) from downhole equipment may include injecting a NORM dissolver into an isolated region of a wellbore in which NORM-contaminated production equipment is located; and removing the NORM contaminants from the production equipment. The method may also include recommencing production of hydrocarbons following the decontamination.

18 Claims, 4 Drawing Sheets

(51) Int. Cl.

| | |
|---|---|
| ***E21B 33/12*** | (2006.01) |
| ***E21B 33/13*** | (2006.01) |
| ***G21F 9/00*** | (2006.01) |

(56) References Cited

U.S. PATENT DOCUMENTS

| | | | | | |
|---|---|---|---|---|---|
| 5,085,709 | A * | 2/1992 | Morris | B09C 1/02 | 134/22.14 |
| 5,183,112 | A | 2/1993 | Paul et al. | | |
| 5,613,242 | A | 3/1997 | Oddo | | |
| 5,961,438 | A * | 10/1999 | Ballantine | B09B 1/00 | 166/305.1 |
| 6,142,232 | A * | 11/2000 | Troutt | E21B 37/06 | 166/305.1 |
| 2003/0172959 | A1* | 9/2003 | Martin | C11D 11/0023 | 134/10 |
| 2007/0158072 | A1* | 7/2007 | Coleman | E21B 43/17 | 166/298 |
| 2011/0220151 | A1* | 9/2011 | Swinford | B08B 9/023 | 134/22.12 |

OTHER PUBLICATIONS

International Preliminary Report on Patentability issued in International Patent application PCT/US2017/028471 dated Oct. 23, 2018, 8 pages.
Examination Report issued in Canadian patent application 3021838 dated Feb. 18, 2019, 6 pages.
Examination Report issued in Canadian patent application 3021838 dated Apr. 30, 2020, 4 pages.

* cited by examiner

IN SITU DECONTAMINATION OF DOWNHOLE EQUIPMENT

CROSS-REFERENCE TO RELATED APPLICATION

The present application claims priority to U.S. Application Ser. No. 62/325,198, filed Apr. 20, 2016, which is incorporated herein by reference in its entirety

BACKGROUND

Subterranean oil recovery operations may involve the injection of an aqueous solution into the oil formation to help move the oil through the formation and to maintain the pressure in the reservoir as fluids are being removed. The injected water, either surface water (lake or river) or seawater (for operations offshore) generally contains soluble salts such as sulfates and carbonates. These salts may be incompatible with the ions already contained in the oil-containing reservoir.

The reservoir fluids may contain high concentrations of certain ions that are encountered at much lower levels in normal surface water, such as strontium, barium, zinc and calcium. Partially soluble inorganic salts, such as barium sulfate (or barite) and calcium carbonate, often precipitate from the production water as conditions affecting solubility, such as temperature and pressure, change within the producing well bores and topsides. This is especially prevalent when incompatible waters are encountered such as formation water, seawater, or produced water.

Some mineral scales have the potential to contain naturally occurring radioactive material (NORM). The primary radionuclides contaminating oilfield equipment include Radium-226 (226Ra) and Radium-228 (228Ra), which are formed from the radioactive decay of Uranium-238 (238U) and Thorium-232 (232Th). While 238U and 232Th are found in many underground formations, they are not very soluble in the reservoir fluid. However, the daughter products, 226Ra and 228Ra, are soluble and can migrate as ions into the reservoir fluids to eventually contact the injected water. While these radionuclides do not precipitate directly, they are generally co-precipitated in barium sulfate scale, causing the scale to be mildly radioactive.

Because barium and strontium sulfates are often co-precipitated with radium sulfate to make the scale mildly radioactive, handling difficulties are also encountered in any attempts to remove the scale from the equipment. Unlike common calcium salts, which have inverse solubility, barium sulfate solubility, as well as strontium sulfate solubility, is lowest at low temperatures, and this is particularly problematic in processing in which the temperature of the fluids decreases. Modern extraction techniques often result in drops in the temperature of the produced fluids (water, oil and gas mixtures/emulsions) (as low as by 5 C) and fluids being contained in production tubing for long periods of time (24 hrs or longer), leading to increased levels of scale formation. Because barium sulfate and strontium sulfate form very hard, very insoluble scales that are difficult to prevent, dissolution of sulfate scales is difficult (conventionally requiring high pH, long contact times, heat and circulation).

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a method of decontaminating naturally occurring radioactive material (NORM) from downhole equipment that includes injecting a NORM dissolver into an isolated region of a wellbore in which NORM-contaminated production equipment is located; and removing the NORM contaminants from the production equipment.

In another aspect, embodiments disclosed herein relate to a method of decontaminating naturally occurring radioactive material (NORM) from downhole equipment that includes isolating NORM-contaminated production equipment from other regions of a wellbore; flushing diesel through the isolated region; injecting a wetting agent into the isolated region to render the NORM-contaminated production equipment water wet; injecting a NORM dissolver into the isolated region; and removing the NORM contaminants from the production equipment.

Other aspects and advantages of the claimed subject matter will be apparent from the following description and the appended claims.

DETAILED DESCRIPTION

In one aspect, embodiments disclosed herein relate to the in situ treatment of downhole equipment contaminated with NORM. Specifically, embodiments of the present disclosure relate to methods of treating downhole production equipment having NORM-containing scale thereon without retrieval of the equipment to the surface.

Conventionally, mineral scale (not containing NORM) may be treated in place, but occasionally, this scale contaminated tubing and equipment is simply removed and replaced with new equipment. However, when the old equipment is contaminated with NORM, the equipment is conventionally removed from the well and replaced, and the equipment is treated (a costly and hazardous affair) to remove the NORM scale therefrom. At present, a considerable amount of oilfield tubular goods and other equipment awaiting decontamination is sitting in storage facilities. Some equipment, once cleaned, can be reused, while other equipment must be disposed of as scrap. Once removed from the equipment, several options for the disposal of NORM exist, including canister disposal during well abandonment, deep well injection, landfill disposal, and salt cavern injection.

Conventional equipment decontamination processes have included both chemical and mechanical efforts, such as milling, high pressure water jetting, sand blasting, cryogenic immersion, and chemical chelants and solvents, all of which occur on topside, not downhole. Water jetting using pressures in excess of 140 MPa (with and without abrasives) has been the predominant technique used for NORM removal. However, use of high pressure water jetting generally requires that each pipe or piece of equipment be treated individually with significant levels of manual intervention, which is both time consuming and expensive, but sometimes also fails to thoroughly treat the contaminated area. When scale includes NORM, this technique also poses increased exposure risks to workers and the environment.

In contrast, embodiments of the present disclosure involve chemical treatment of the NORM-contaminated equipment downhole without retrieving the equipment to the surface to await a backlog of equipment needing NORM decontamination. However, in other embodiments, the equipment may be retrieved to the surface after the NORM decontamination occurs, in case, for example, the equipment needs to be repaired or replaced for reasons other than the NORM contamination. Though, by treating the equipment in situ prior to retrieving it to the surface, repair or disposal can commence immediately, rather than first waiting for NORM decontamination to occur.

Figure 1:
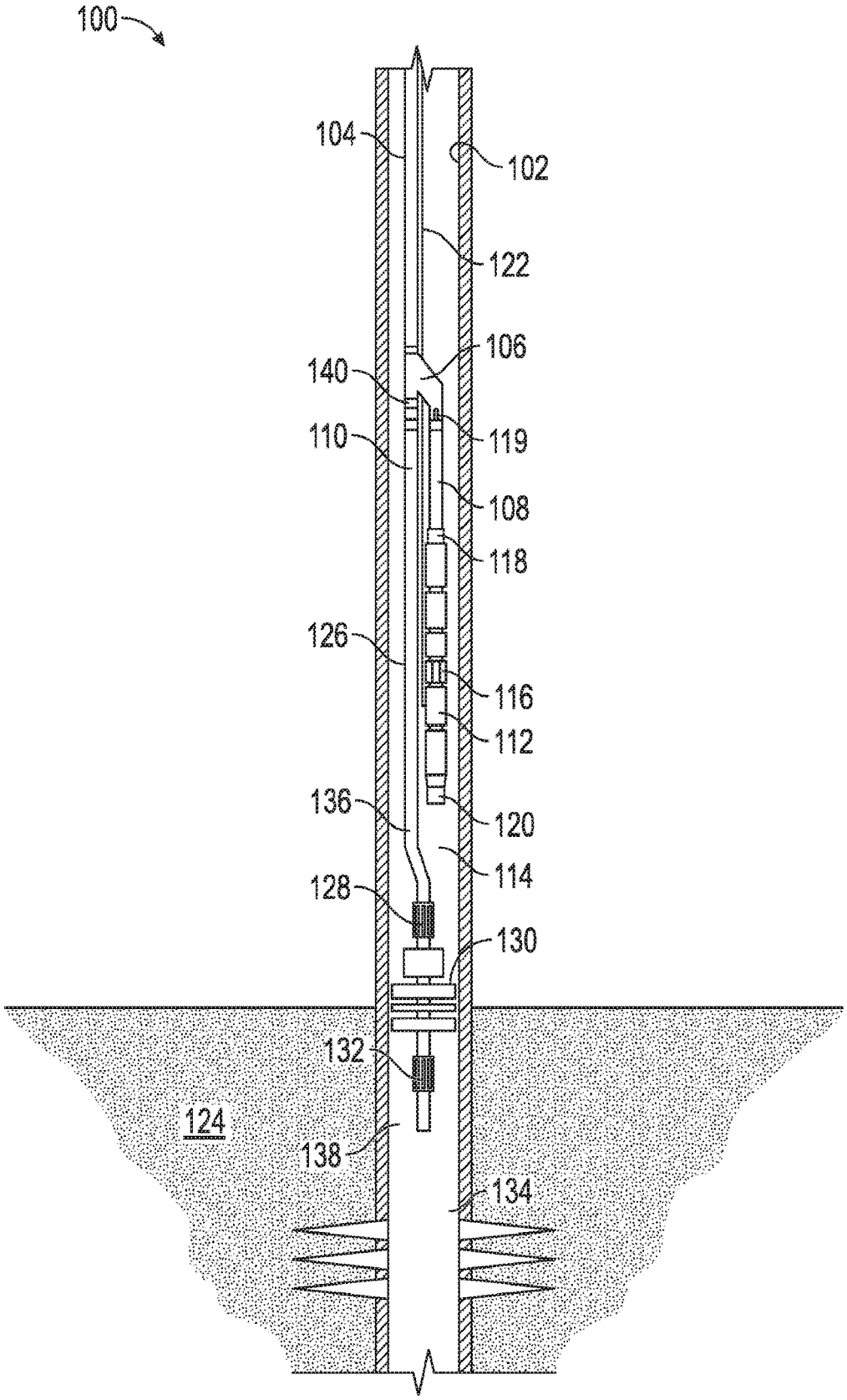
FIG. 1-4 show embodiments of downhole production equipment that may be treated in accordance with the present disclosure.

Referring initially to FIG. 1, a production apparatus 100 in accordance with one or more embodiments of the present disclosure is shown. Production apparatus 100 is deployed to a wellbore lined with casing 102 upon the end of a string of production tubing 104 extending from a surface station (not shown). Production tubing 104 terminates at its distal end into a Y-shaped union commonly known as a Y-tool 106. Below Y-tool 106 and in fluid communication with production tubing 104 are a pump string 108 and a bypass string 110. Furthermore, while a Y-tool 106 is shown, it should be understood by one of ordinary skill in the art that any style fluid union can be used to connect production tubing 104 with bypass string 110 and pump string 108.

Pump string 108 extends further into casing 102 and includes a pump assembly 112. Pump assembly 112 may be configured to pump wellbore fluids from upper region 114 of casing 102, up through production tubing 104, and to a surface station above the well. Pump assembly 112 may be constructed as an electric submersible pump that includes an inlet 116 and an outlet 118 in communication with pump string 108. A check valve 119 ensures that fluids (e.g. NORM dissolving chemicals) from production tubing 104 and bypass string 110 will not flow into pump assembly 112 unless desired. Optionally, a sensor package 120 mounted to pump assembly 112 records and reports downhole conditions to a pump controller (not shown) or a surface station. Furthermore, a control and power line 122 extends from pump assembly 112, alongside production tubing 104 to a surface control station. Those having ordinary skill will appreciate that control and power line 122 may vary in construction depending on the pump assembly 112. For example, if pump assembly 112 is pressure driven, control and power line 122 may comprise one or more fluid conduits in communication with a surface pressure source and pump assembly 112.

Bypass string 110 may run alongside pump string 108 inside casing 102 and extend deeper into a production zone 124. Bypass string 110 may include a bypass section 126, an upper fluid gate 128, a packer assembly 130, and a lower fluid gate 132. Upper and lower fluid gates 128, 132 are devices designed to selectively allow and disallow fluids from outside bypass string 110 to communicate with a bore 136 of bypass string 110. Fluid gates 128 and 132 may be constructed as sliding sleeve type devices, but any remotely operable fluid gate devices can be used. Packer 130 may be expanded after production apparatus 100 is delivered to cased wellbore and acts to hydraulically seal off the annulus between bypass string 110 and cased wellbore and divide that annulus into upper 114 and lower regions 138. A plug 140 capable of being set into and retrieved from bypass tubing 110 selectively allows or blocks off direct communication between bypass tubing 110 and production tubing 104. Plug 140 can either be a physical device deployed and retrieved through production tubing 104 from the surface or can be an electrically or hydraulically operable shutoff valve. Furthermore, if plug 140 is a remotely operable valve, it may be configured to allow large diameter items to pass therethrough when open. For example, a remotely operable flapper valve can be used for plug 140.

With both upper and lower fluid gates 128, 132 open, fluid communication between upper and lower regions 114 and 138 is permitted. With upper fluid gate 128 open and lower fluid gate 132 closed, only upper region 114 is in communication with production tubing 104 and pump assembly 112. With upper fluid gate 128 closed and lower fluid gate 132 open, only lower region 138 is in communication with production tubing 104. By selectively manipulating upper fluid gate 128, lower fluid gate 132, and plug 140, numerous operations can be performed on cased wellbore and production zone 124, pump assembly 112, or other production string components without detrimentally effecting other components.

During production, pump assembly 112 pumps production fluids from lower zone 138 adjacent to production zone 124 to a surface location through production tubing 104. To retrieve or produce fluids which have flowed into lower zone 138 below packer 130, upper and lower fluid gates 128, 132 are opened and plug 140 is again re-set in bypass string 110. Pump assembly 112 is then activated and fluids from upper zone 114 are drawn into pump assembly 112 through inlet 116 and pumped up through pump string 108, Y-tool 106, and production tubing 104 to a surface destination. As fluids are removed from upper zone 114 by pump assembly 112, they are replenished by formation fluids entering lower zone 138 through perforations 146. These fluids travel through lower fluid gate 132, across packer 130, and out upper fluid gate 128 to upper zone 114. Because plug 140 prevents bypass string 110 from directly communicating with production tubing 104, pump assembly 112 is able to displace fluids from lower zone 138 to surface location through production tubing 104. Absent plug 140, pump assembly 112 would only circulate fluids between bypass string 110 and upper zone 114.

Further, in one or more embodiments, a work conduit (not shown) extends from within production tubing 104, through Y-tool 106, through bypass string 110, past upper fluid gate 128, through packer 130, and through lower fluid gate 132. Work conduit may be a wireline assembly, capillary tubing, slickline, fiber-optic line, or coiled tubing, etc. Work conduit can be deployed either to take measurements or to perform work operations. Such work operations can include the injection of treatment chemicals, the manipulation of downhole equipment (e.g. valves), and the cleansing of bores of the production apparatus 100. Such measurements can include temperature, pressure, density, and resistivity of downhole fluids.

In one or more embodiments, the system of FIG. 1 may be used to perform NORM decontamination of one or more components of the production apparatus 100 while emplaced in the wellbore. Specifically, bypass string 110 may be used to deliver one or more NORM dissolvers downhole (such as through work conduit). Depending on the component of the production apparatus needing decontamination, the NORM dissolver may be delivered to the appropriate location within the well, while closing off, for example, the producing zone 124 and/or other sections or components of the production apparatus 100. For example, in the event that one or more components of the pump assembly is to be decontaminated, the upper fluid gate 128 may be opened and lower fluid gate 132 may be closed, so that only upper region 114 is in communication with production tubing 104 and pump assembly 112. NORM dissolvers may be applied, and depending on the chemistry of the dissolvers involved a pre-flush with diesel followed by a wetting agent may be first circulated into the upper region 114 to render the contaminants water wet prior to circulation of the NORM dissolver into the upper region 114 and through the pump assembly 112. A production logging tool containing a gamma densitometer may be run before and after the treatment with the NORM dissolver to verify removal of NORM. Prior to re-commencing production, the pump assembly 112 and upper region may be optionally re-flushed with a fluid such as diesel or water. Such fluid containing the dissolved scale may be produced or may be flushed into the formation.

Further, while the Y-tool and bypass equipment described in FIG. 1 may readily allow for the isolation of the producing zone 124 from the pump assembly 112, the present disclosure is not limited to the use of the particular production apparatus 100 shown in FIG. 1. Rather, it is envisioned that in any wellbore, the producing zone (and potentially lower completion equipment) may be shut off by a through-tubing plug and cement or a polymeric gel or plug, allowing for treatment of one or more parts of the upper completion.

Figure 2:
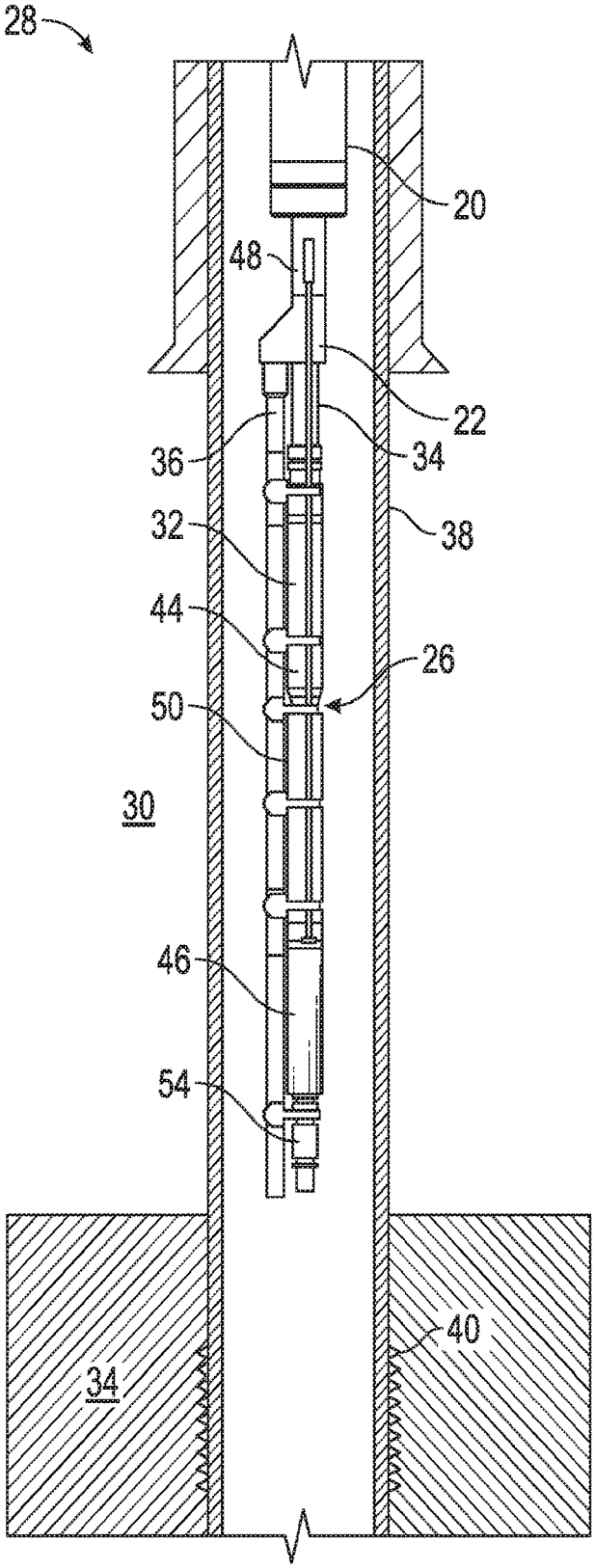

Referring to FIG. 2, an embodiment of downhole production equipment that may be treated in accordance with the present disclosure is shown. In this embodiment, a wellbore 28 extends through a geological formation 30. As illustrated, wellbore 28 is lined with a wellbore casing 38 having perforations 40 through which fluid flows between producing zone 34 and wellbore 28. A string of production tubing 20 extends from a surface station (not shown) and terminates at its distal end at a Y-tool 22. Below Y-tool 22 and in fluid communication with production tubing 20 are a pump string 34 and a bypass string 36.

An electric submersible pumping system 26 is suspended below pump string 34. For example, a hydrocarbon-based fluid may flow from formation 30 through perforations 40 and into wellbore 28 adjacent electric submersible pumping system 26. Upon fluids entering wellbore 28, pumping system 26 is able to produce the fluid upwardly through pump string 34, Y-tool 22, and production tubing 20 to wellhead (not shown) and on to a desired collection point.

Although electric submersible pumping system 26 may comprise a wide variety of components, the example in FIG. 2 is illustrated as having a submersible pump 32, a pump intake 44, and an electric motor 46 that powers submersible pump 32. Motor 46 receives electrical power via a power cable 48 and is protected from deleterious wellbore fluid by a motor protector 50. In addition, pumping system 26 may comprise other components including a sensor unit 54. One or more of these components of the electric submersible pump 26 may be treated in situ to perform NORM decontamination therefrom, such as by shutting off the producing zone 30 (by packer, plug, and/or cement) from the pumping system 26, and then circulating a NORM dissolver in the section of the wellbore containing NORM-contaminated equipment. Further, while an electric submersible pump is illustrated, it is envisioned that other artificial lift components including other pumps or gas lifts may be treated accordingly as well.

In addition to a pump assembly, other production equipment that may be treated in accordance with methods of the present disclosure include, but are not limited to, subsurface safety valves, packers, injection mandrels, gas lifts, monitoring equipment, cables, etc.

Figure 3:
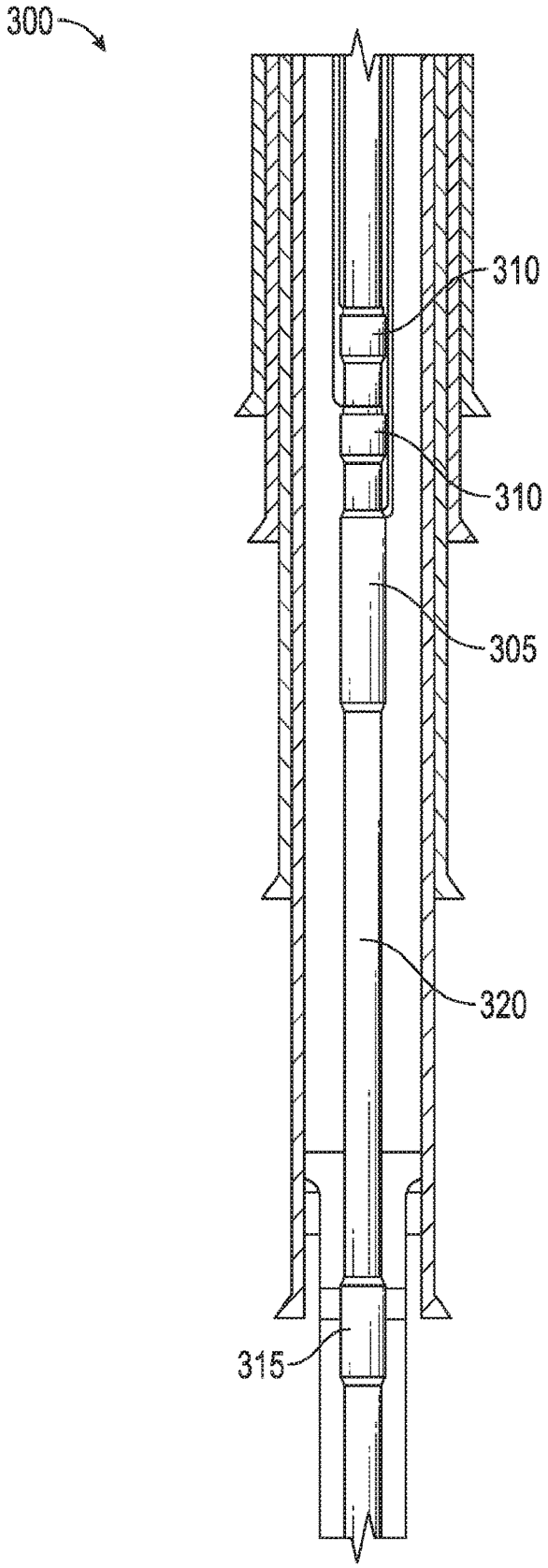

For example, referring to FIG. 3, another schematic of production equipment is shown. As shown, production equipment 300 may include a subsurface safety valve 305 installed in the upper wellbore to provide emergency closure of the producing conduits in the event of an emergency. There is no limitation on the type of valve that may be used, but in one embodiment, it may be a flapper type valve. Also included in production equipment 300 are one or more chemical injection mandrels 310 connected to chemical injection line(s) for injecting one or more chemicals into the wellbore, and one or more packers 315 for isolating various regions of the wellbore from one another. Further, the location of the components on the production string 320 is not limited, and it is envisioned, for example, that the subsurface safety valve 305 may be above the injection mandrel, etc. Depending on the component needing NORM decontamination and its location, additional isolations may be emplaced in the well to protect the producing zone and/or other equipment. NORM dissolvers may be injected through the injection mandrel or through other means into the well, depending on the location of the component to be decontaminated.

Figure 4:
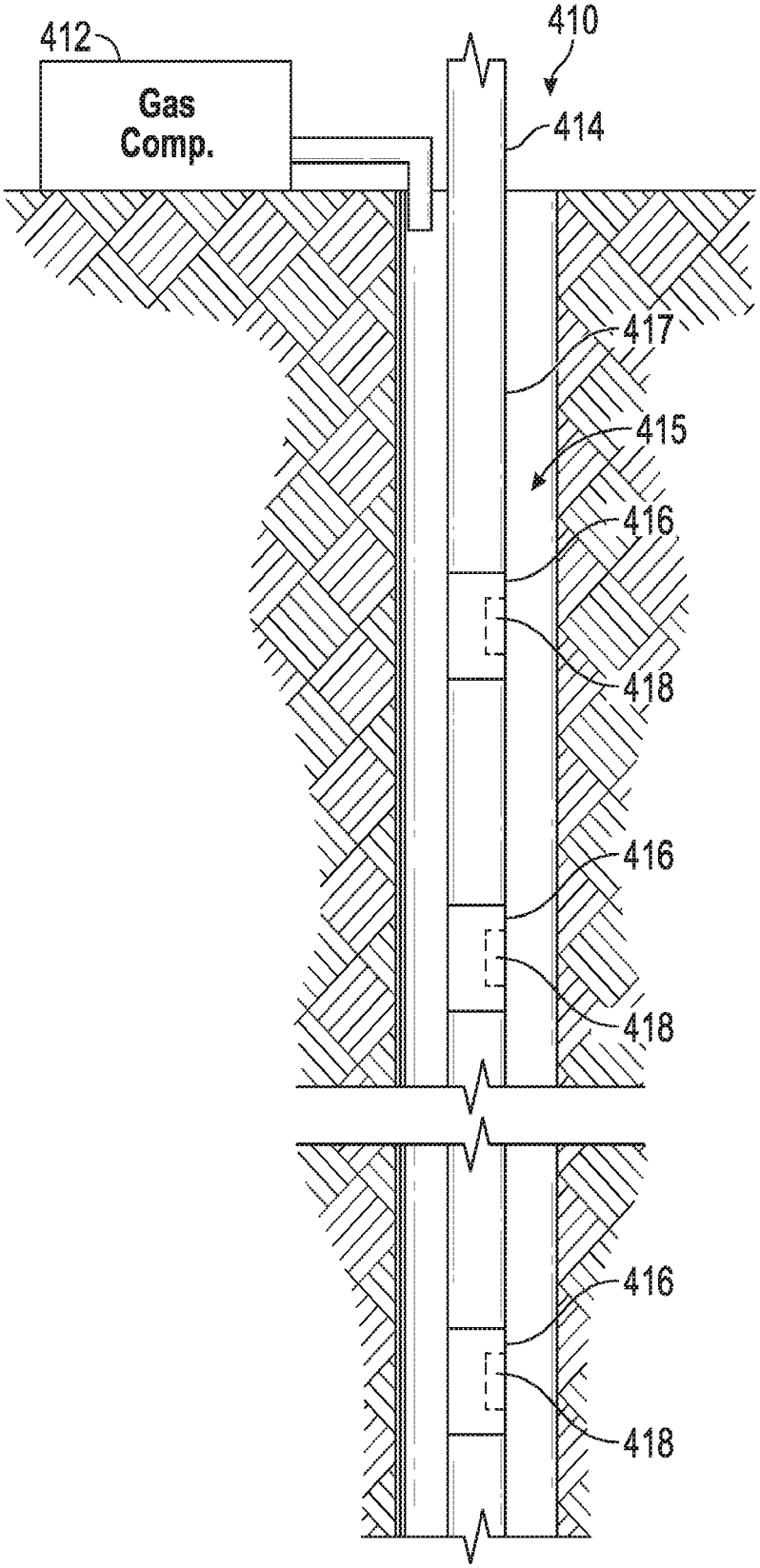

Referring now to FIG. 4, FIG. 4 depicts a gas lift system 410 that includes a production tubing 414 that extends into a wellbore. For purposes of gas injection, the system 410 includes a gas compressor 412 that is located at the surface of the well for purposes of introducing pressurized gas into an annulus 415 of the well. To control the communication of gas between the annulus 415 and a central passageway 417 of the production tubing 414, the system 410 may include several gas lift mandrels 416. Each one of these gas lift mandrels 416 includes an associated gas lift valve 418 that responds to the annulus pressure. More specifically, when the annulus pressure at the gas lift valve 418 exceeds a predefined threshold, the gas lift valve 418 opens to allow communication between the annulus 415 and the central passageway 417. For an annulus pressure below this threshold, the gas lift valve 416 closes and thus, prevents communication between the annulus 415 and the central passageway 417.

Mineral scale that may be effectively removed from oilfield equipment in embodiments disclosed herein includes oilfield scales, such as, for example, salts of alkaline earth metals or other divalent metals, including sulfates of barium, strontium, radium, and calcium, carbonates of calcium, magnesium, and iron, metal sulfides, iron oxide, and magnesium hydroxide. That is, the scale may include NORM, and may also include other mineral scale precipitated therewith. The NORM may also include radioactive plating that has occurred on the production equipment from non-farrous radioactive metals such as Lead 210 and Pollonium 210.

In one or more embodiments, NORM dissolver may include a chelating agent. The chelating agent that may be used in the solution to dissolve the metal scale may be a polydentate chelator so that multiple bonds with the metal ions may be formed in complexing with the metal. Polydentate chelators suitable for use in embodiments disclosed herein include, for example, ethylenediaminetetraacetic acid (EDTA), diethylenetriaminepentaacetic acid (DTPA), nitrilotriacetic acid (NTA), ethyleneglycoltetraacetic acid (EGTA), 1,2-bis(o-aminophenoxy)ethane-N,N,N',N'-tetraacetic acid (BAPTA), cyclohexanediaminetetraacetic acid (CDTA), triethylenetetraaminehexaacetic acid (TTHA), salts thereof, and mixtures thereof. However, this list is not intended to have any limitation on the chelating agents suitable for use in the embodiments disclosed herein. One of ordinary skill in the art would recognize that selection of the chelating agent may depend on the metal scale to be dissolved. In particular, the selection of the chelating agent may be related to the specificity of the chelating agent to the particular scaling cation, the log K value, the optimum pH for sequestering and the commercial availability of the chelating agent.

In a particular embodiment, the chelating agent used to dissolve metal scale is EDTA, and/or DTPA, or salts thereof. Salts of EDTA and DTPA may include, for example, alkali metal salts and depending on the pH of the dissolving solution different salts or the acid may be present in the solution.

In one or more embodiments, the NORM dissolver may be a metal nitrate (the metal having a lower electronegativity than the contaminants). In a particular embodiment, the NORM dissolver may be zirconium nitrate, which may optionally be used in conjunction with an oxidizing agent such as $H_2O_2$.

Further, as mentioned, the NORM dissolver may be preceded by circulation of diesel and/or a wetting agent to render the tool surfaces (and NORM scale) water wet. Further, following the NORM dissolver treatment, a fluid (such as diesel or water) may be flushed through the region to remove the NORM dissolver. The dissolved NORM may be removed from the wellbore either by production or by flushing the material back into the formation (such as by opening the isolation).

Following treatment, a gamma tool may be used to verify that the NORM material has been dissolved and removed from the tool on which it had precipitated. This logging may be compared to a log conducted prior to NORM treatment. Further, after treatment, production of hydrocarbons may resume, though, in some embodiments, it is envisioned that a tool could be replaced (even the tool having been decontaminated) if the tool is not operational for other reasons. However, the downhole treatment of the tool will present fewer risks to the operator and avoid a backlog of equipment topside needing NORM decontamination.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed:

1. A method of decontaminating naturally occurring radioactive material (NORM) from downhole equipment, the method comprising:

circulating a wetting agent through an isolated region of a wellbore comprising NORM-contaminated production equipment such that the NORM-contaminated production equipment is rendered water wet;

chemically treating the NORM-contaminated production equipment by injecting, after circulation of the wetting agent, one or more NORM dissolving chemicals into the isolated region of a wellbore such that a bypass string delivers a NORM dissolver of the one or more NORM dissolving chemicals to an appropriate location with the wellbore or one or more chemical injection mandrels inject the NORM dissolver into the wellbore at the appropriate location, and the appropriate location is dependent on a location of NORM-contaminated production equipment within the wellbore; and removing the NORM contaminants from the production equipment;

wherein the method further comprises:

running a first gamma log before the injecting;

running a second gamma log after the injecting; and verifying whether NORM has been removed.

2. The method of claim 1, further comprising:

isolating the NORM-contaminated production equipment from other regions of the wellbore.

3. The method of claim 2, wherein the isolation of the NORM-contaminated production equipment is achievable by at least one packer.

4. The method of claim 2, wherein the isolation of the NORM-contaminated production equipment is achievable by at least one of a cement plug, a polymeric plug, and a gel plug.

5. The method of any of claim 1, further comprising:

flushing a fluid through the isolated region prior to circulation of the wetting agent.

6. The method of any of claim 1, further comprising:

flushing diesel through the isolated region after removal of the NORM contaminants.

7. The method of claim 1, wherein the NORM dissolver comprises at least one chelating agent.

8. The method of claim 1, wherein the NORM-contaminated production equipment comprises an artificial lift.

9. The method of claim 8, wherein the NORM-contaminated production equipment comprises an electric submersible pump.

10. The method of claim 8, wherein the NORM-contaminated production equipment comprises a gas lift.

11. The method of claim 1, wherein the NORM-contaminated production equipment comprises at least one valve.

12. The method of claim 1, wherein the NORM-contaminated production equipment comprises a packer.

13. The method of claim 1, wherein the NORM-contaminated production equipment comprises a cable.

14. The method of claim 1, wherein the NORM-contaminated production equipment comprises monitoring equipment.

15. The method of claim 1, further comprising:

resuming production of hydrocarbons using the production equipment.

16. A method of decontaminating naturally occurring radioactive material (NORM) from downhole equipment, the method comprising:

isolating NORM-contaminated production equipment from other regions of a wellbore;

flushing diesel through the isolated region;

injecting a wetting agent into the isolated region to render the NORM-contaminated production equipment water wet;

chemically treating the NORM-contaminated production equipment by injecting, after injection of the wetting agent, one or more NORM dissolving chemicals into the isolated region such that a bypass string delivers a NORM dissolver of the one or more NORM dissolving chemicals to an appropriate location with the wellbore or one or more chemical injection mandrels inject the NORM dissolver into the wellbore at the appropriate location, and the appropriate location is dependent on a location of NORM-contaminated production equipment within the wellbore; and removing the NORM contaminants from the production equipment;

wherein the method further comprises:

running a first gamma log before the injecting of the one or more NORM dissolving chemicals;

running a second gamma log after the injecting of the one or more NORM dissolving chemicals; and verifying whether NORM has been removed.

17. The method of claim 16, further comprising:

resuming production of hydrocarbons using the production equipment.

18. A method of decontaminating naturally occurring radioactive material (NORM) from downhole equipment, the method comprising:

running a first gamma log;

chemically treating the NORM-contaminated production equipment by injecting one or more NORM dissolving chemicals into an isolated region of a wellbore in which NORM-contaminated production equipment is located such that a bypass string delivers a NORM dissolver of the one or more NORM dissolving chemicals to an appropriate location with the wellbore or one or more chemical injection mandrels inject the NORM dissolver into the wellbore at the appropriate location, and the appropriate location is dependent on the location of NORM-contaminated production equipment within the wellbore;

removing the NORM contaminants from the production equipment;

running a second gamma log; and verifying whether NORM has been removed based on the first gamma log and the second gamma log.

* * * * *